US006279302B1

(12) United States Patent
Kuchler

(10) Patent No.: US 6,279,302 B1
(45) Date of Patent: Aug. 28, 2001

(54) SHEET-INTERPOSING DEVICE FOR AUTOMATIC SLICING MACHINE

(76) Inventor: Fritz Kuchler, Klatteweg 4-6, A-9020 Klagenfurt (AT)

( * ) Notice: Subject to any disclaimer, the term of this patent is extended or adjusted under 35 U.S.C. 154(b) by 0 days.

(21) Appl. No.: 09/505,464

(22) Filed: Feb. 16, 2000

(30) Foreign Application Priority Data

Feb. 17, 1999 (AT) ..... 260/99

(51) Int. Cl.[7] ..... B65B 63/00; B26D 7/32

(52) U.S. Cl. ..... 53/517; 53/514; 53/389.3; 53/389.4; 83/86; 83/170; 83/176; 83/441; 83/648; 83/932

(58) Field of Search ..... 83/86, 932, 648, 83/649, 175, 176, 441, 443, 170, 171; 53/520, 514, 517, 540, 541, 171, 172, 175, 389.3, 389.5, 389.1, 389.4

(56) References Cited

U.S. PATENT DOCUMENTS 1,967,579 * 7/1934 Krueger ..... 83/176 X
3,488,918 * 1/1970 Felstehausen ..... 53/389.3
4,008,554 * 2/1977 Hardy ..... 53/453
4,134,246 * 1/1979 Michels ..... 53/389.3 X
4,185,527 * 1/1980 Kuchler ..... 83/88
4,338,836 * 7/1982 Kuchler ..... 83/94
4,354,408 * 10/1982 Carte ..... 83/176 X
4,510,841 * 4/1985 Farran et al. ..... 83/176
4,524,558 * 6/1985 Miles ..... 53/157
4,586,632 * 5/1986 Kuchler ..... 221/63
5,101,702 * 4/1992 Kuchler ..... 83/932 X
5,138,823 * 8/1992 Hartmann et al. ..... 53/520
5,253,560 * 10/1993 McDonald et al. ..... 83/175 X
5,426,917 * 6/1995 Daane et al. ..... 53/517 X
5,918,444 * 7/1999 Kuchler ..... 83/932 X

* cited by examiner

*Primary Examiner*—Charles Goodman
(74) *Attorney, Agent, or Firm*—Herbert Dubno; Andrew Wilford

(57) ABSTRACT

A slicing machine that deposits foodstuff slices in a stack atop a support in a stacking station has a sheet-interposing device provided with a supply roll of sheet material and a feed roller for feeding a leading end of the sheet material in a direction to the stacking station. a guide between the station and the roller imparts to the sheet leading end an upwardly concave U-shape to stiffen the sheet leading end so it projects horizontally stiffly from the guide above the station. A cutter movable between the guide and the station cuts off the sheet leading end so that the cut-off end drops down in the station.

5 Claims, 2 Drawing Sheets

SHEET-INTERPOSING DEVICE FOR AUTOMATIC SLICING MACHINE

FIELD OF THE INVENTION

The present invention relates to an automatic slicing machine. More particularly this invention concerns a device for interposing sheets between, under, and on top of a stack of slices deposited on a substrate by such a machine.

BACKGROUND OF THE INVENTION

A standard slicing machine has an input table that can be reciprocated longitudinally past a normally circular rotating blade to cut slices from a foodstuff, for instance a piece of meat or cheese, sitting on the input table. On the other side of the blade the slices are picked up by a conveyor, typically a fork-, belt-, or chain-type arrangement having a vertical support plate and provided with a multiplicity of sharp points so that the slices can be caught on the conveyor as they issue from the downstream side of the blade. A transfer fork has tines engaged between adjacent elements of the conveyor and can be pivoted to pull the slices off the conveyor and deposit them on an output table which is positioned horizontal underneath the downstream side of the blade. Thus as the input table is moved back and forth, slices are cut from the foodstuff thereon, these slices pass the blade and are picked up the conveyor, and the transfer fork deposits them in a stack on the output table. Such machines are described in detail in my earlier U.S. Pat. Nos. 4,185,527, 4,217,650, 4,338,836, 4,379,416, 4,586,409, 4,598,618, 4,763,738, and 4,867,257.

In order to separate the slices from each other, to separate groups of slices, and/or to form a package around the slices, it is known to insert underneath the stack, between the slices, and/or on top of the stack a sheet or foil. In one system a sheet is set on the conveyor before the stack is started so that the stack is formed atop this bottom sheet, then sheets are interposed between succeeding slices as they are deposited on the bottom sheet and on each other or are interposed after a certain number of slices corresponding to a standard portion has been deposited. A top sheet is deposited on top of the stack when the desired number of slices have been deposited.

The standard system for doing this has a supply, normally a roll, of the sheet material and a feeder that is typically a pair of pinch rollers that can be driven to pull the sheet material from the roll. The end of the roll is pushed by the rollers out onto a flat table and a cutter slices off the end. Then a separate manipulator normally having a plurality of suction grippers picks the sheet formed by the cut-off end and deposits it on the conveyor where the foodstuff slices are stacked.

While such a system is highly effective, it is quite complex. The device for paying out the sheet material and cutting it off is relatively simple, but the manipulator for picking up the cut-off sheet and depositing it in the stacking station is fairly complex. It has not only a relatively sophisticated articulated mechanism, but must be connected by suction lines to a pump and must be controlled by plural actuators.

OBJECTS OF THE INVENTION

It is therefore an object of the present invention to provide an improved sheet-interposing device for an automatic slicing machine.

Another object is the provision of such an improved sheet-interposing device for an automatic slicing machine which overcomes the above-given disadvantages, that is which is of simple construction but that accurately cuts and positions sheets in the stacking station of the slicing machine.

SUMMARY OF THE INVENTION

A slicing machine that deposits foodstuff slices in a stack atop a support in a stacking station has a sheet-interposing device provided with a supply roll of sheet material and a feed roller for feeding a leading end of the sheet material in a direction to the stacking station. According to the invention a guide between the station and the roller imparts to the sheet leading end an upwardly concave U-shape to stiffen the sheet leading end so it projects horizontally stiffly from the guide above the station. A cutter movable between the guide and the station cuts off the sheet leading end so that the cut-off end drops down in the station.

By imparting to the leading end of the sheet a U-shape centered generally on a horizontal axis extending in the sheet-travel direction, this leading end can be extended in the air across the stacking station with no other support. When the cutter slices off the leading end, it drops down flat atop the conveyor or atop the top sheet of the stack. Thus this arrangement completely eliminates the complex manipulator that carries a cut sheet from a cutting station to the stacking station. All that is needed is sheet material that is sufficiently stiff that, when shaped according to the invention, it is stiff enough to support itself in the stacking station.

In accordance with the invention the guide is formed as a plate with an upwardly concave U-shaped slot through which the sheet material passes. This is an extremely simple construction, especially as compared to the complex articulated manipulator used to date. It would also be possible to form the guide of a group of rollers arrayed in an arc or some other structure to convert the sheet material, which is flat and planar as it issues from the feed roller, to the desired upwardly concave shape that is stiff enough to hold its shape when only supported at one end.

The cutter is a blade displaceable transverse to the direction along the plate. Thus this blade simply rides along the plate, using one edge of the slot as a counterblade.

The supply includes a pair of rollers pinching the sheet material. This ensures that accurate lengths of the sheet material will be pulled off the roll and fed to the stacking station with each cycle.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
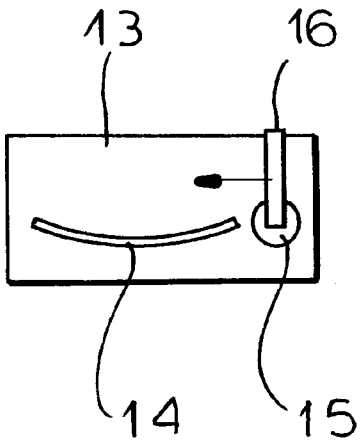
FIG. 2 is a side view of parts of the sheet-interposing device.
Figure 1:
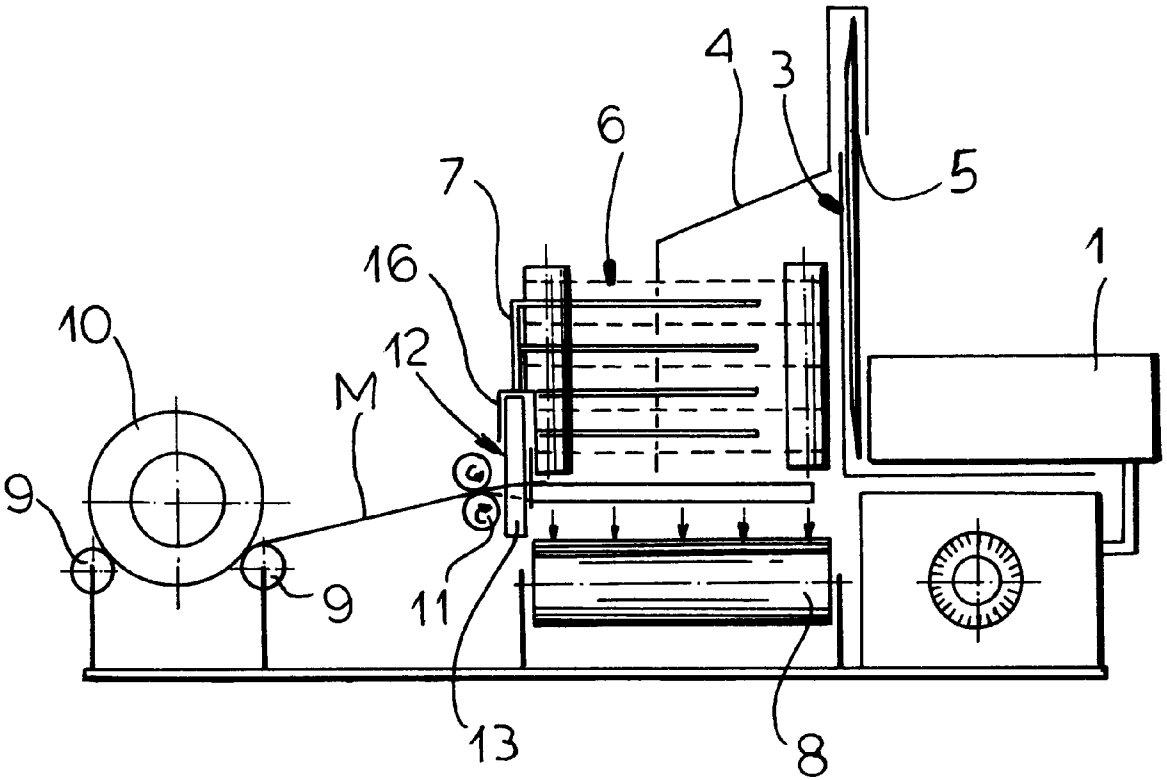
FIG. 1 is an end view of the system according to the invention.
Figure 3:
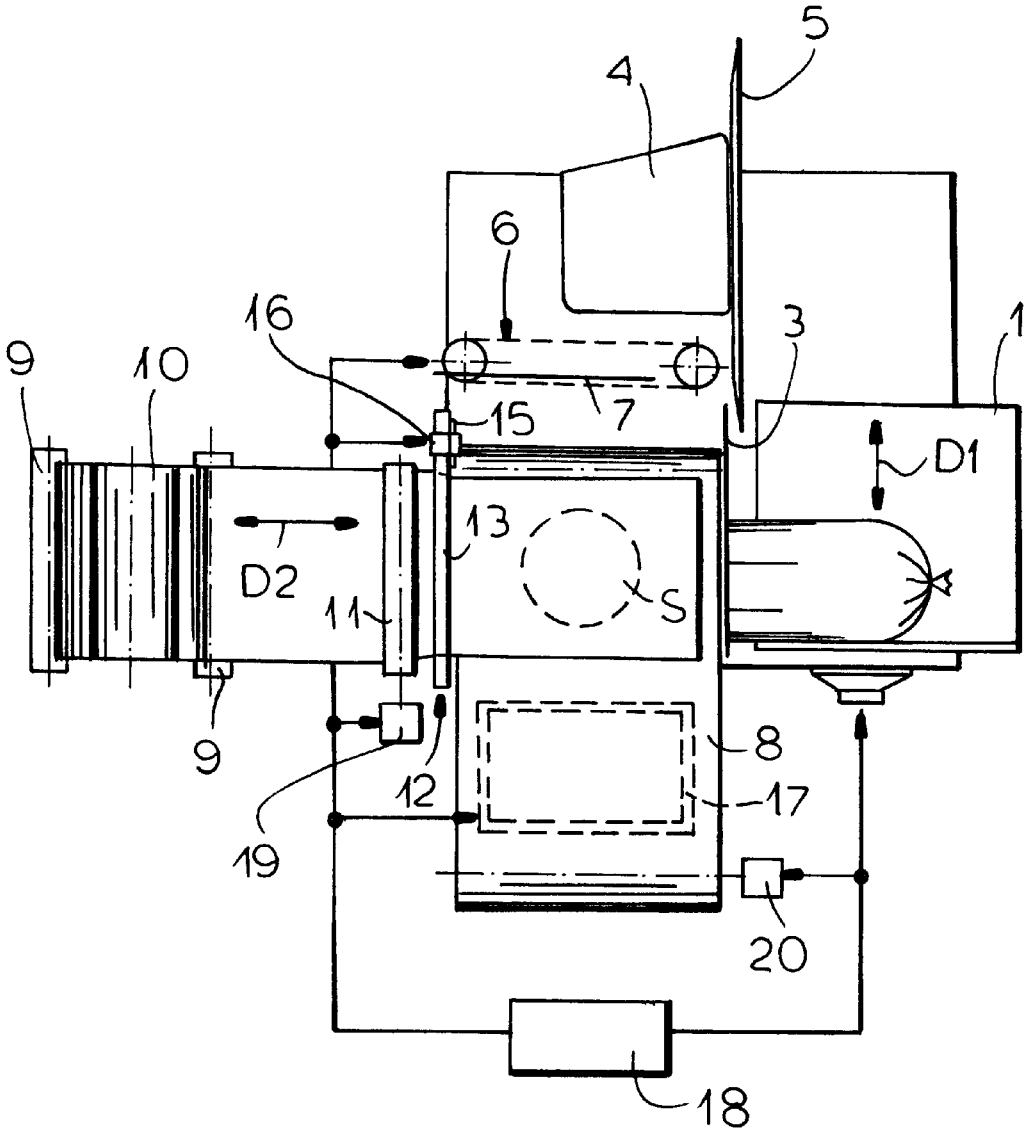
FIG. 3 is a partly schematic top view of the system.

As seen in the drawing a slide table 1 supports a foodstuff 2, here a wurst, for reciprocation in a horizontal direction D1 along a vertical guide plate 3 past a circular blade 5 rotatable in a vertical plane by an electric motor 4. The slices S that are thus produced are picked up on the opposite side of the blade 5 by a standard picker-chain conveyor 6 and are deposited by a fork 7 horizontally on a support surface formed by the upper face of the top stretch of a conveyor belt 8. Normally the belt 8 is only advanced after a predetermined number of slices S have been deposited on it. This is all standard.

According to the invention a pair of rollers 9 support a supply roll 10 from which sheet material M is pulled by a pair of pinch feed rollers 11 to advance it in a horizontal direction D2 through a guide 12 comprising a plate 13 formed with an upwardly concave arcuate guide slot 14. A cutter disk 15 carried on a carriage 16 can slide along this plate 13 to cut off an end of the sheet material M projecting in the direction D2 from the plate above the conveyor 8. Due to the upwardly curved arcuate shape of the slot 14, the flexible sheet material M will project horizontally stiffly from the plate 13 in the stacking station above the conveyor 8 and will not fold down or droop appreciably. Only when the end has been cut off will it drop down onto the conveyor 8 or onto the stack of slices S thereon.

The conveyor 8 can move the stack of slices S and any sheets cut from the roll 10 into a downstream sealing station having an annular tool indicated schematically at 17 for sealing together the outer edges of the sheets in the stack. This tool 17 is operated by a controller 18 which also operates the drive motor 4 for the blade 5, drive motors 19 and 20 for the feed rollers 11 and conveyor 8 and is connected as well to the unillustrated actuators for the carriage 16 and, conveyor 6, and fork 7.

With this system before the actual slicing is started, the controller 18 feeds a relatively long piece of the sheet material M out and cuts it off so that it drops a short distance down onto the conveyor 8. Then the table 1 is reciprocated and slices S are deposited atop this bottom sheet until a predetermined portion comprising, for instance, eight slices S is stacked on the bottom sheet. Then the material M is advanced and a smaller sheet is set atop the first eight-slice portion, eight more slices are deposited, another short sheet is dropped on the second portion, and a third portion of eight slices is stacked atop the second separator sheet. Finally another long sheet is set atop the stack of 24 slices and four cut-off sheets, and the entire stack is moved into the sealing station where the peripheries of the larger top and bottom sheets are sealed together, making a neat hermetically sealed package.

The intermediate separator sheets can be fed from a separate roll of lighter and narrower material, also fed through the U-shaped guide. When the intermediate separator sheets are of the same width as the top and bottom sheets, they are sealed together so that slicing open an end of the finished package allows a portion to be taken out of a pocket formed between captured sheets.

I claim:

1. In combination with a slicing machine that deposits foodstuff slices in a stack atop a support in a stacking station, a sheet-interposing device comprising:

supply means including a roll of flexible sheet material and a feed roller for feeding in a direction to the stacking station a leading end of the sheet material having an area greater than an area of the stack in the station;

means including a guide between the station and the roller for imparting to the sheet leading end an upwardly concave U-shape and thereby stiffening the sheet leading end so the sheet leading end projects horizontally stiffly from the guide above the station;

means including a cutter movable between the guide and the station for cutting off the sheet leading end and dropping the cut-off end down in the station atop the support when the station is empty and, when there is a stack on the support, atop the stack on the support with a periphery of the dropped cut-off sheet projecting horizontally past the stack on the support; and means including an annular heat-sealing tool engageable downward with the periphery of the cut-off sheets on the support all around the stack for enclosing the stack in the cut-off sheets.

2. The device defined in claim 1 wherein the guide is formed as a plate with an upwardly concave U-shaped slot through which the sheet material passes.

3. The device defined in claim 2 wherein the cutter is a blade displaceable transverse to the direction along the plate.

4. The device defined in claim 1 wherein the supply means includes a pair of rollers pinching the sheet material.

5. The device defined in claim 1, further comprising:

a conveyor forming the support surface and displaceable in a predetermined horizontal transport direction, the supply means feeding the sheet leading end in a horizontal direction transverse to the transport direction.

* * * * *